United States Patent [19]

Troncoso

[11] Patent Number: 4,683,865

[45] Date of Patent: Aug. 4, 1987

[54] COMPOUND ARCHERY BOW

[75] Inventor: Vincent F. Troncoso, Montrose, Colo.

[73] Assignee: Golden Key-Futura, Inc., Montrose, Colo.

[21] Appl. No.: 850,011

[22] Filed: Apr. 10, 1986

[51] Int. Cl.[4] ..... F41B 5/00

[52] U.S. Cl. ..... 124/24 R; 124/DIG. 1; 124/88

[58] Field of Search ..... 124/23 R, 24 R, DIG. 1, 124/88

[56] References Cited

U.S. PATENT DOCUMENTS

| | | | |
|---|---|---|---|
| 3,486,495 | 12/1969 | Allen | 124/24 R |
| 4,195,397 | 4/1980 | Saunders | 124/23 R |
| 4,203,412 | 5/1980 | Rickard | 124/23 R |
| 4,261,321 | 4/1981 | Nishioka | 124/25 |
| 4,300,521 | 11/1981 | Schmitt | 124/23 R |
| 4,448,183 | 5/1984 | Quartino et al. | 124/24 R |
| 4,461,267 | 7/1984 | Simonds et al. | 124/23 R |
| 4,471,747 | 9/1984 | Nishioka | 124/23 R |
| 4,542,732 | 9/1985 | Toncoso | 124/24 R |
| 4,562,824 | 1/1986 | Jennings | 124/23 R |
| 4,599,986 | 7/1986 | Nishioka | 124/24 R |
| 4,612,906 | 9/1986 | Troncoso | 124/24 R |

*Primary Examiner*—Anton O. Oechsle

*Assistant Examiner*—Benjamin Layno

*Attorney, Agent, or Firm*—Donald E. Nist

[57] ABSTRACT

The compound archery bow includes a central riser section with handle and bow window on one side and first and second limbs connected to opposite ends of the riser. The limbs bear eccentric levers, such as wheels eccentrically mounted on transverse axles. A telescoping arm is secured to the riser and extends rearwardly thereof, bearing a rotatable wheel on the outside thereof and adjacent its rear end. A bowstring is disposed longitudinally between the limbs behind the riser. A first cable is connected at one end to the bowstring and at the other end to the first limb axle. It is locked intermediate its ends to a first circular groove in the arm wheel and is secured to the lever in the first limb. A second cable is similarly connected at one end thereof to the opposite end of the bowstring and at the other end thereof to the second limb axle. It is locked intermediate its ends to a second circular groove in the arm wheel and is secured to the lever in the second limb. Only one of the two cables crosses itself intermediate its ends. The telescoping arm permits easy adjustment of draw length and draw weight and the arm wheel prevents damage to the limbs of the bowstring breaks. The arm also provides necessary arrow clearance of the cables without distorting the limbs.

5 Claims, 7 Drawing Figures

COMPOUND ARCHERY BOW

BACKGROUND OF THE INVENTION

1. Field of the Invention

The present invention generally relates to sports equipment and more particularly to an improved type of compound archery bow.

2. Prior Art

U.S. Pat. No. 3,486,495 to Holless Allen is directed to the pioneer compound archery bow. Many variations have been provided subsequently, but the original bow described in the above-listed patent has remained popular. Such a bow employs pulleys, levers or the like attached to its limbs to develop a mechanical advantage and/or a so-called draw force curve. Thus, through the use of, for example, an eccentrically mounted wheel disposed in the tip of each bow limb and cables connected thereto and trained thereover and also connected to the bowstring, a bow is provided which when drawn by the bowstring exhibits an initially increasing draw resistance until the so-called break-over point is reached in the latter portion of the draw, whereupon the resistance to drawing decreases. This enables the archer to draw a bow of overall greater draw weight and to more easily hold the bowstring at full draw, for greater shooting accuracy. Conventional non-compound bows become more difficult to draw as the drawing proceeds to full draw and thus are hard to hold at full draw.

Moreover, upon release of the bowstring, the compound bow gradually accelerates the arrow rather than initially applying maximum force to it, and ramming it as occurs with non-compound bows. Therefore, the compound bow bends the arrow less than conventional bows, allowing more usable force to be directed along the length of the arrow shaft, propelling the arrow more rapidly toward the target, rather than dissipating the driving force in arrow shaft bending. Thus, lighter, thinner walled arrows can be used, resulting in much greater arrow speed, a flatter arrow flight trajectory and greater shooting accuracy.

However, because of less side bending of the arrow shaft and the presence of the cables adjacent the bowstring, there is a danger when using a compound bow that the arrow feathers or vanes will strike the cables and/or arrow rest, causing them to wear and deflect the arrow from its intended flight path. It is now conventional to solve this problem by connecting a cable guard to the bow riser. Such a guard is an arm which extends laterally and rearwardly from the riser and holds the cables on the lateral side thereof away from the arrow window, bowstring and arrow path. This, however, places a twisting force or side torque on the limb tips which can cause their premature failure, particularly if the bowstring breaks suddenly, shocking both limbs. In such instances, the limbs frequently break, causing great danger to the archer.

Most compound bows are in any event difficult to restring and require a bow press or string changer device, neither of which are likely to be available if the archer is on a hunting trip, or even on the target or field range. Moreover, most compound bows are also difficult to adjust in draw weight and draw length. Most such adjustments cannot be made without some dismantling of the bow. A further difficulty is that the opposite limb tips have to be interconnected through the cables in order to provide the block and tackle effect, achieving mechanical assistance and simultaneous roll-over (break-over) of the wheels or levers. The cables have to be crossed over each other in order to function properly and wear of both cables may occur over a period of time. Breakage of the bowstring or a cable simultaneously adversely affects the limbs, cables and bowstring.

Accordingly, there is a need for an improved compound archery bow which will provide easier adjustment of draw length and draw weight to meet precise requirements for improved performance of the bow and ideal arrow flight. Such bow should also be easier to restring, obviating the need of complicated cumbersome restringing devices, and should provide greater safety to the archer and bow in case of bowstring breakage. Preferably, the bow should also incorporate better protection against limb torque while providing necessary cable clearance for unimpeded arrow flight.

SUMMARY OF THE INVENTION

The improved compound archery bow of the present invention satisfies all the foregoing needs. The bow is described substantially as set forth in the Abstract. Thus, the bow includes a riser with a handle and an arrow window, a pair of limbs, the free ends of which bear eccentrically mounted wheels or levers, and a novel telescoping arm rearwardly extending from the riser and bearing a rotatable wheel on the side opposite the arrow window.

Each of the two bow cables is connected to a separate one of the limb tips and to the wheel in that tip, as well as to a separate one of the two parallel grooves in the arm wheel and to one end of the bowstring. One cable is crossed over itself so that upon drawing the bowstring, rotation of the arm wheel in a given direction properly effects the action of both cables and the eccentric limb wheels to provide the desired draw force curve and other compound bow properties. The arm wheel essentially interconnects the limbs while protecting them from damage by bowstring breakage. The wheel arm and wheel keep the cables out of the arrow flight path without substantially torquing the limb tip. Moreover, the draw length and draw weight are adjusted simply, rapidly and conveniently by merely adjusting the length of the wheel arm. Restringing of the bow can be accomplished without a bow press or the like, due to the increased inner prebending of the bow limbs provided by the unique cable and wheel system. Thus, the archer can merely manually press down on the upper limb while the lower limb is on a solid surface. Whereupon the new bowstring can be easily clipped into place on the opposed free ends of the two cables to complete the restringing. Such restringing can take place anywhere, including in the field during a hunting trip.

Further features of the invention are set forth in the following detailed description and accompanying drawings.

DRAWINGS

DETAILED DESCRIPTION

FIGS. 1–7

Figure 1:
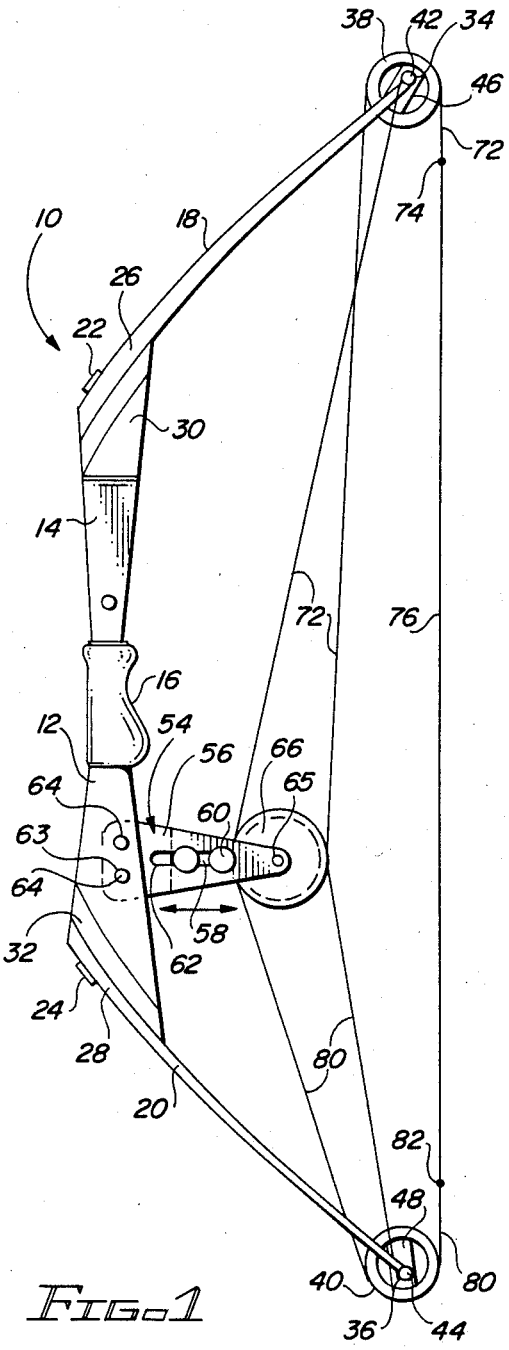
FIG. 1 is a schematic side elevation of a right-handed version of a preferred embodiment of the improved compound archery bow of the present invention.
Figure 2:
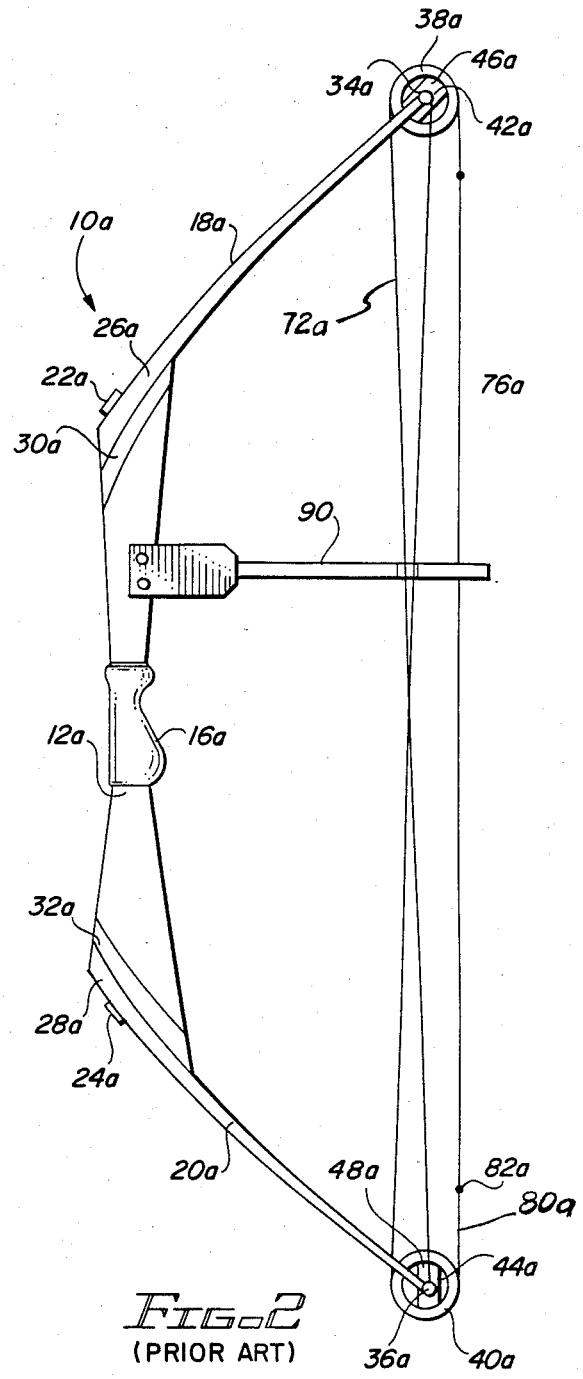
FIG. 2 (PRIOR ART)
FIG. 2 is a schematic side elevation of a left-handed version of a conventional compound archery bow for comparison purposes.
Figure 5:
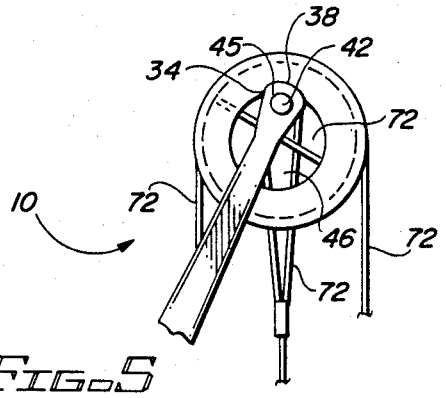
FIG. 5 is an enlarged schematic side elevation of the upper limb tip and eccentric wheel portion of the bow of FIG. 1.
Figure 6:
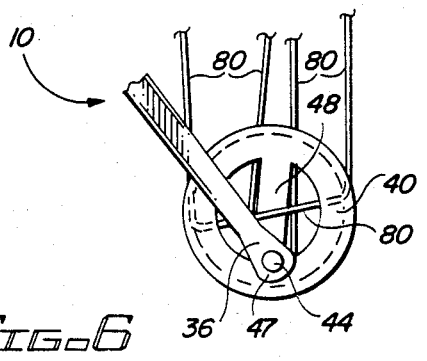
FIG. 6 is an enlarged schematic side elevation of the lower limb tip and eccentric wheel portion of the bow of FIG. 1; and, FIG. 7 is a schematic rear elevation of a right-handed version of the conventional compound archery bow depicted in FIG. 2, for comparison purposes.
Figure 3:
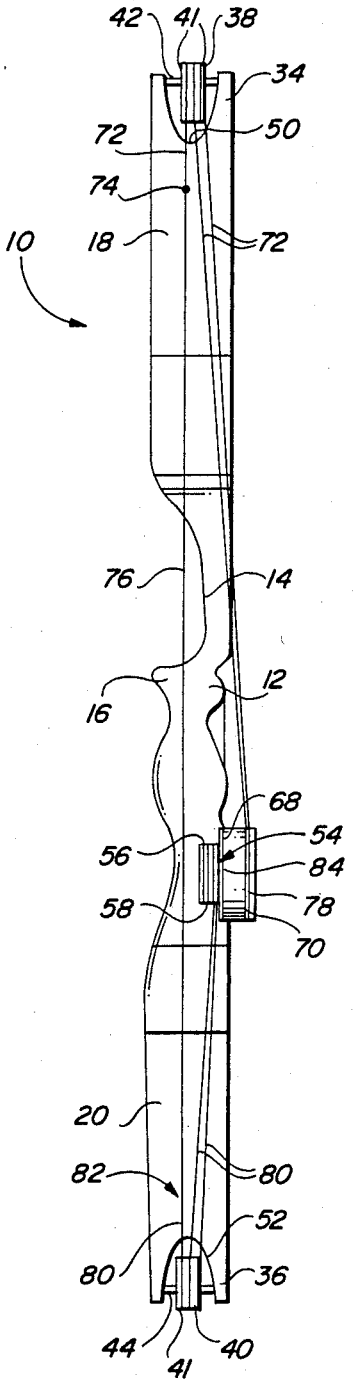
FIG. 3 is a schematic rear elevation of the bow of FIG. 1.
Figure 4:
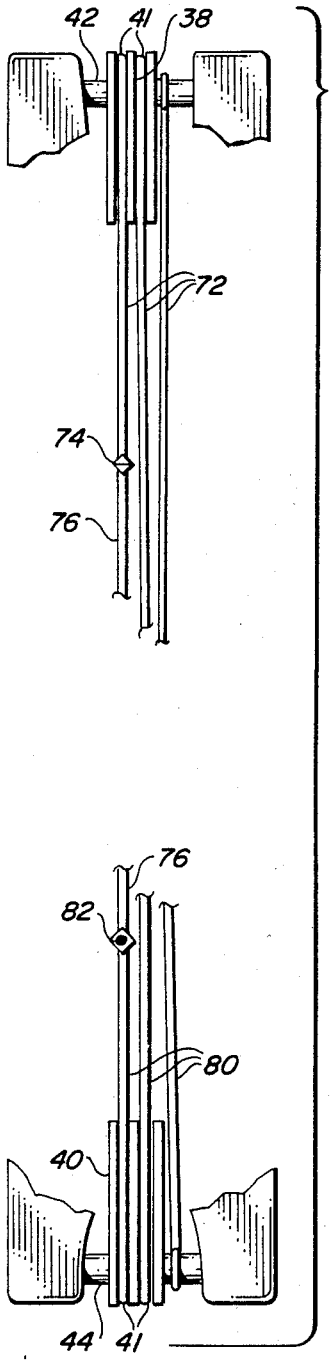
FIG. 4 is an enlarged fragmentary rear elevation of the eccentric wheel, cable and bowstring portions of the bow of FIG. 1.
Figure 7:
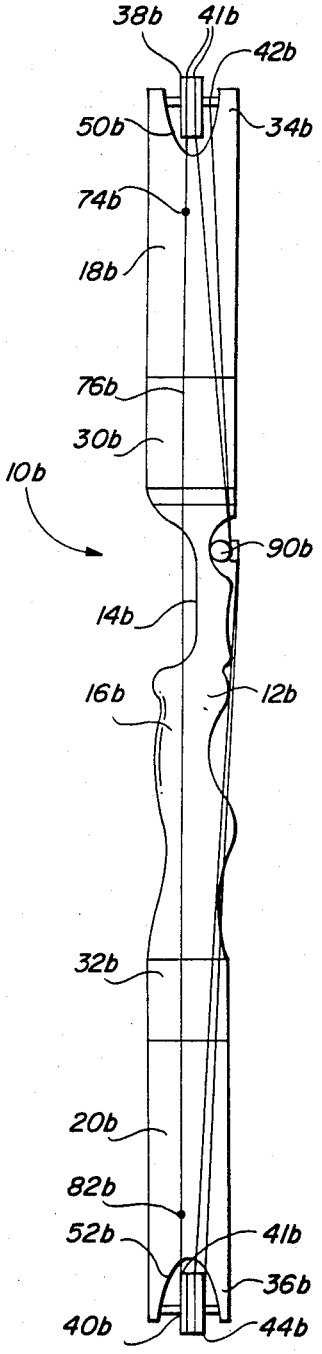
FIG. 7 (PRIOR ART)

Now referring more particularly to the drawings, a preferred embodiment of the improved compound archery bow of the present invention is schematically depicted in FIG. 1 and in FIGS. 3–6. A conventional compound archery bow is schematically depicted in FIGS. 2 and 7 for comparison. FIG. 2 shows a left-handed version of that bow and FIG. 7 a right-handed version of that bow.

In FIG. 1, a bow 10 is shown which comprises an elongated central riser portion 12 of wood, metal or the like in which are defined an arrow window 14 and a handle 16 therebelow. A pair of resilient rearwardly extending limbs 18 and 20 are preferably releasably connected, as by bolts 22 and 24, at their ends 26 and 28 to the sloped ends 30 and 32 of riser 12. Limbs 18 and 20 are preferably fabricated of composite wood-plastic, or carbon fiber-plastic material or the like.

At the free tips 34 and 36 of limbs 18 and 20, respectively, are eccentrically mounted wheels 38 and 40, respectively, as by crossbars 42 and 44, respectively, extending (transversely) through non-central points 45 and 47, in the web portions 46 and 48 (FIGS. 5 and 6) of wheels 38 and 40, respectively. Wheels 38 and 40 each bear a pair of parallel circular grooves 41 therein. In the resting state shown in FIGS. 1 and 3–6, points 45 and 47 are located above and below, respectively, the centers of wheels 38 and 40. Wheels 38 and 40 are disposed ih V-shaped notches 50 and 52 in tips 34 and 36 and extend slightly therebeyond. Wheels 38 and 40 are oriented in a forward-rearward plane relative to bow 10, perpendicular to the wide flat sides of limbs 18 and 20, respectively.

Bow 10 also includes a rearwardly extending pylon or telescoping arm 54 comprised of two plates 56 and 58 (FIG. 1), plate 58 being disposed at the side of and sliding forwardly and rearwardly relative to plate 56 and releasably adjustably pinned thereto by screws or bolts 60 extending transversely through a slot 62 in plate 56 and holes 63 in plate 58. The front of plate 56 is secured, as by bolts 64, to the side of riser 12 opposite from that in which arrow window 14 is defined. Arm 54 may, for example, be triangularly shaped, and be made of metal or the like. It bears on a crosspin 65 on its outer margin a rotatable arm wheel 66 having a pair of spaced circular grooves 68 and 70 therein. Wheel 66 and arm 54 are preferably disposed below handle 16 to avoid interference with target sighting.

Bow 10 also includes a first cable 72, one end of which is looped over and secured to crossbar 42 and the other end of which is preferably releasably secured, as by a connector 74, to a bowstring 76 which extends between limbs 18 and 20 behind riser 12. Cable 72 runs to groove 70 in wheel 66 and is releasably locked therein, as by a cleat 78, then runs around in a first groove 41 around wheel 38, after which is crosses through an opening therein (FIG. 5) to the second parallel groove 41 in wheel 38, so as to be secured to wheel 38, then exits wheel 38 to connect to bowstring 76. Cable 72 crosses itself in its described course, as shown in FIG. 1.

A second cable 80 has one end thereof releasably connected to bowstring 76, as by a connector 82, and its opposite end is looped over and connected to crossbar 44 in limb tip 36, while its intermediate portion runs to and is releasably secured in groove 68 by a cleat 84, then runs in a first groove 41 around wheel 40, then through wheel 40 to a second groove 41 therein, being thereby secured to wheel 40, after which cable 80 exits wheel 40 and connects to bowstring 76. Cable 80 is not crossed over itself (FIG. 1), so that unidirectional rotation of wheel 66 can be effected upon drawing bowstring 76 and causing the desired rotation of wheels 38 and 40 and movement of cables 72 and 80.

It will be noted that arm 54 and wheel 66 hold cables 72 and 80 well away from window 14 and bowstring 76 so that an arrow can be fired from bowstring 76 through window 14 without interference with cables 72 and 80, arm 54 and wheel 66. This obviates the necessity of using a cable guard such as guards 90 and 92 shown in FIGS. 1 and 7.

When it is desired to change bowstring 76, wheel 66 holds cables 72 and 80 tightly and in place so that limb 18 can be hand pressed down toward limb 20, so that bowstring 76 can be freed from connectors 74 and 82 and a new bowstring substituted. In case of sudden breakage of bowstring 76, limbs 18 and 20 are kept secure by cables 72 and 80 being locked to wheels 38 and 40 and wheel 66. Limb breakage therefore does not result nor is there danger to the archer. When it is desired to change the draw weight and/or draw length of bow 10, bolt(s) 60 can be loosened and plate 58 slid to the right position relative to plate 56, then retightened against plate 56 by bolt(s) 60. Further advantages of the improved compound bow of the present invention are set forth in the foregoing.

For comparison purposes, the left-handed prior art bow 10*a* of FIG. 2 bears the same numerals but succeeded by the letter "a" for similar components to those of bow 10. It will be noted that cable 72*a* is trained around wheel 38*a* but passes all the way down to crossbar 44*a* connected to wheel 40*a*, while cable 80*a* is trained around wheel 40*a* and terminates at crossbar 42*a*. Cables 72*a* and 80*a* run the length of bow 10*a* and cross, and cable guard 90 is required to force them out of the intended arrow path. FIG. 7 shows an identical but right-handed version of bow 10*a*, identified as bow 10*b*, and components thereof bear the same numerals but are succeeded by the letter "b".

It will be noted that bow 10 is quite different in components, arrangement of components, functions and advantages from conventional bows 10*a* and 10*b*. Various modifications, changes, alterations and additions can be made in bow 10 and its components and their parameters. All such modifications, changes, alterations and additions as are within the scope of the appended claims form part of the present invention.

The eccentric rotatable wheels of bow 10 could be substituted for by eccentrically mounted lever arms ( not shown ), and act as pulleys to provide with the cables trained therearound a block and tackle array which provides a mechanical advantage in drawing bow 10.

What is claimed is:

1. An improved compound archery bow, said bow comprising, in combination:

a. an elongated archery bow riser having a handle and an arrow window on one side thereof;

b. first and second resilient limbs connected at one end thereof to opposite ends of said riser;

c. first and second lever means eccentrically rotatably connected, respectively, to the free ends of said first and second limbs;

d. an arm connected to said riser and extending rearwardly therefrom, said arm comprising at least two telescoping members releasable locked together;

e. a dual track wheel rotatably secured to said arm and being forwardly and rearwardly adjustable behind said riser by said arm to adjust the draw length and draw weight of said bow;

f. a bowstring disposed longitudinally of said bow behind said riser; and, g. first and second cables connected to opposite ends of said bowstring, the opposite end of said first cable being connected to the free end of said first limb and the opposite end of said second cable being connected to the free end of said second limb, said first cable intermediate its ends also being locked in one track of said arm wheel and secured to said first eccentric lever means, while said second cable intermediate its ends is locked to said other track in said arm wheel and secured to said second eccentric lever means.

2. The improved compound archery bow of claim 1 wherein said eccentric lever means comprise wheels which lie in a forward-rearward plane and at about the longitudinal axis of said bow and are connected to said limb ends by crossbars passing transversly through said eccentric wheels at points other than the centers thereof.

3. The improved archery bow of claim 2 wherien said arm is secured to said riser on the side opposite said window and wherein said wheel is in a plane generally parallel to said eccentric wheels and is connected to the lateral side of said arm, whereby said cables by connection to said arm wheel are maintained out of the flight path of an arrow through said window.

4. The improved compound archery bow of claim 2 wherein said cables are releasably connected to said bowstring, and wherein said cables are releasably locked to said arm wheel and pass through openings in said eccentric wheels to secure said cables thereto.

5. The improved compound archery bow of claim 1 wherein said cables interconnect said limbs only through said arm wheel and wherein one of said cables remains uncrossed over itself.

* * * * *